US007753220B2

(12) United States Patent
Konstant

(10) Patent No.: US 7,753,220 B2
(45) Date of Patent: Jul. 13, 2010

(54) REINFORCED AND BOLTED RACK TRUSS

(75) Inventor: Anthony N. Konstant, Winnetka, IL (US)

(73) Assignee: Konstant Products, Inc., Skokie, IL (US)

( * ) Notice: Subject to any disclaimer, the term of this patent is extended or adjusted under 35 U.S.C. 154(b) by 581 days.

(21) Appl. No.: 11/341,262

(22) Filed: Jan. 27, 2006

(65) Prior Publication Data

US 2007/0175846 A1 Aug. 2, 2007

(51) Int. Cl.
*A47B 57/00* (2006.01)
*E04C 3/02* (2006.01)
*E04H 12/00* (2006.01)

(52) U.S. Cl. ..... 211/191; 211/189; 52/693; 52/481.1; 52/655.1

(58) Field of Classification Search ..... 52/690, 52/693, 651.01, 651.07, 317, 481.1, 481.2, 52/653.1, 655.1, 241, 696, 654.1, 656.9, 52/651.1; 211/189, 191, 187, 190, 182, 148, 211/176, 177, 134, 208, 192, 19, 18; 248/225.11, 248/223.41, 224.61, 220.21, 220.22, 240.2, 248/200, 300, 188.1, 677, 218.4, 219.4; 403/230, 262; 182/228.1
See application file for complete search history.

(56) References Cited

U.S. PATENT DOCUMENTS 1,356,749 A * 10/1920 Sorg ..... 182/220
1,838,796 A * 12/1931 Tingleaf ..... 182/228.3
1,961,781 A * 6/1934 Reagle ..... 182/228.3
2,194,810 A * 3/1940 Reiner ..... 52/695
2,618,427 A * 11/1952 Langley et al. ..... 182/220
2,619,687 A * 12/1952 Kahn ..... 52/217
2,776,030 A * 1/1957 Bush ..... 403/230
RE24,535 E * 9/1958 Franks ..... 211/191
2,867,855 A * 1/1959 Xanten ..... 182/97
2,918,176 A * 12/1959 Bell et al. ..... 211/191
3,001,615 A * 9/1961 Ries ..... 403/230
3,072,262 A * 1/1963 Cassel ..... 211/191
3,102,641 A * 9/1963 Konstant et al. ..... 211/191
3,285,428 A * 11/1966 Scheck ..... 211/191
3,523,613 A * 8/1970 Konstant ..... 211/191
3,625,372 A * 12/1971 MacKenzie ..... 211/191
3,647,080 A * 3/1972 Denny ..... 211/191
3,664,513 A * 5/1972 Atwater ..... 211/134
3,669,479 A * 6/1972 Payne ..... 403/230
3,905,483 A * 9/1975 Patrick ..... 211/190
3,918,686 A * 11/1975 Knott et al. ..... 256/59
4,007,570 A * 2/1977 Hunter ..... 52/317
4,011,926 A * 3/1977 Larson et al. ..... 182/107
4,048,059 A * 9/1977 Evans ..... 108/155
4,078,664 A * 3/1978 McConnell ..... 211/189
4,088,229 A * 5/1978 Jacoby et al. ..... 211/191
4,118,816 A * 10/1978 Mittag ..... 14/69.5
4,586,585 A * 5/1986 Zaner ..... 182/97
4,616,950 A * 10/1986 Morris ..... 403/231
4,678,091 A * 7/1987 Konstant et al. ..... 211/191
4,687,404 A * 8/1987 Seiz et al. ..... 414/276
4,798,262 A * 1/1989 Margolies ..... 182/106

(Continued)

*Primary Examiner*—Robert J Canfield
*Assistant Examiner*—Babajide Demuren
(74) *Attorney, Agent, or Firm*—Niro Haller & Niro

(57) ABSTRACT

A rack truss for use in forming shelf-type storage racks which may be assembled at the site using bolts and/or which includes reinforcement at the lower level of the rack truss.

4 Claims, 10 Drawing Sheets

U.S. PATENT DOCUMENTS 5,310,066 A * 5/1994 Konstant ..... 211/193
5,313,752 A * 5/1994 Hatzinikolas ..... 52/243
5,316,157 A * 5/1994 Konstant ..... 211/151
5,369,925 A * 12/1994 Vargo ..... 52/244
5,544,866 A * 8/1996 Dye ..... 256/69
5,749,481 A * 5/1998 Miller ..... 211/191
5,906,080 A * 5/1999 diGirolamo et al. ..... 52/243.1
5,943,838 A * 8/1999 Madsen et al. ..... 52/846
5,946,867 A * 9/1999 Snider et al. ..... 52/167.1
5,956,916 A * 9/1999 Liss ..... 52/655.1
6,161,359 A * 12/2000 Ono ..... 52/651.1
6,186,725 B1 * 2/2001 Konstant ..... 414/276
6,189,277 B1 * 2/2001 Boscamp ..... 52/317
6,298,537 B1 * 10/2001 Dion ..... 29/402.06
6,481,582 B1 * 11/2002 Rinderer ..... 211/26
6,578,335 B2 * 6/2003 Poliquin ..... 52/481.2
6,604,640 B1 * 8/2003 Jehin ..... 211/191
6,609,621 B2 * 8/2003 Denny et al. ..... 211/189
6,612,087 B2 * 9/2003 diGirolamo et al. ..... 52/712
6,691,880 B2 2/2004 Kostant
6,776,298 B2 * 8/2004 Courtwright ..... 211/191
6,843,035 B1 * 1/2005 Glynn ..... 52/573.1
7,490,806 B2 * 2/2009 Rioux ..... 248/345.1
2003/0010739 A1 * 1/2003 Konstant ..... 211/189

* cited by examiner

REINFORCED AND BOLTED RACK TRUSS

BACKGROUND OF THE INVENTION

The present inventions relate generally to improved shelf-type storage racks. More particularly, the present inventions relate to rack trusses that are bolted together for ease of shipment and assembly and/or which are reinforced at the bottom to prevent damage to the trusses by, among other things, lift trucks during loading or unloading.

Shelf-type storage racks are well known in the storage and warehouse industries. Such racks typically include at least four columns, two in the front or access aisle and two in the back. Lateral beams interconnect the pairs of front columns and pairs of back columns. The lateral beams, in conjunction with optional cross members between the lateral beams, form shelves used for storage of pallets and their loads. Typically, there is a shelf approximately 48 inches from the ground and then shelves above the lowest shelf spaced approximately every 48 inches, or for other loads at load required increments.

Each pair of front and back columns are provided with transverse support beams that interconnect the front and back columns. Diagonal support braces between the front and back columns may also be provided for increased strength, rigidity and stiffness. Each pair of front and back columns and the associated beams and braces are typically referred to in the industry as rack trusses. Each pair of opposing rack trusses, and their interconnecting lateral beams, form a typical shelf-type storage rack. The racks may be placed side-by-side and/or back-to-back in arrays to form the desired storage rack system.

The components that form the storage rack trusses, such as the transverse supports and diagonal support braces, are typically welded together and painted at the fabrication site and then shipped to the storage facility. For example, the transverse supports and any diagonals are typically welded to the front and back columns to form the rack truss. Once at the storage facility, the lateral beams interconnecting each opposing pair of trusses are installed by welding or bolting (see e.g., U.S. Pat. No. 4,678,091). The bottom of the columns of the rack trusses may be placed directly on the warehouse floor. Because the trusses are fabricated prior to shipping and installation, known rack trusses are somewhat difficult to handle during assembly, take-up more space during shipping and can be difficult to paint.

In use, the pallets and their loads are placed on or removed from the shelves using a fork lift truck. Experience has shown that the bottom portion of the rack truss and particularly, the bottom 4-6 inches of the truss, take the most abuse. For example, the bottom portion of the front columns at the access aisle, are often bumped by pallets or the forks of a lift truck during the placement or removal of pallets and their loads. This can result in, among other things, a weakened rack structure.

SUMMARY OF THE INVENTION

The present inventions preserve the advantages of known storage racks and storage rack trusses and also provide new features and advantages. For example, the present inventions provide storage racks and rack trusses that may be bolted together at the site making shipping and assembly more efficient and/or which provide reinforcement in the lower portion of the truss to resist abuse from forks of fork trucks and the like.

In a preferred embodiment of the present inventions, a bolted truss for use in forming storage racks is provided including at least one front column having an interior face and at least one rear column having an opposing interior face. A plurality of stubs secured to the interior face and flange of the front column and a series of stubs similarly secured to the interior of the rear column, with the stubs on the front and rear columns opposing each other. A preferred embodiment also includes a plurality of transverse beams having a front and back end which are placed between the front and rear columns, the front end of which is bolted to the stub on the front column and the rear end of which is bolted to the opposing stub on the rear column. The stubs and transverse beams may be formed of structural angles. In addition, at least one diagonal brace may also be provided which is attached to the stubs. A preferred embodiment of the present invention may also include a truss reinforcement means.

Another preferred embodiment of the present inventions is a reinforced truss for use in storage racks including at least one front column having an interior face and at least one rear column having an opposing interior face. The preferred embodiment also includes a horizontal locking tab secured to the inside face of the front column and a vertical locking tab spaced rearwardly from said front column; a horizontal locking tab secured to the inside face of the rear column; and, a horizontal stiffening member including a front end and a rear end, having a vertical support leg spaced rearwardly from the front end, the front end of the horizontal stiffening member capable of being bolted to the horizontal locking tab of the front column, and the rear end capable of being bolted to the horizontal locking tab on the rear column, and the vertical support leg capable of being bolted to the vertical locking tab. The preferred embodiment may also include a vertical locking tab on the rear column and a vertical support leg on the rear end of horizontal support leg such that the rear vertical support leg may be bolted to the rear vertical locking tab. This preferred embodiment may also include means for assembling the truss using bolts.

Accordingly, it is an object of the present inventions to provide a rack truss that may be assembled by bolts.

It is another object of the present inventions to provide a rack truss that provides reinforcement of the columns at the lower portion of the truss.

It is an additional object of the present inventions to provide a rack truss that is assembled using bolts and which provides reinforcement of the columns at the lower portion of the truss.

Yet another object of the present inventions is to provide a bolted truss that self-aligns during assembly of the upright portion of the truss.

Yet an additional object of the present inventions is to provide a bolted and/or reinforced rack truss that can be used for drive-in rack systems.

Still another object of the present inventions is to provide a bolted and/or reinforced rack truss that can be used for push-back rack systems.

A further object of the present inventions is to provide a rack truss that is easy to fabricate, paint, ship, assemble and install.

INVENTOR'S DEFINITION OF THE TERMS

The terms used in the claims of this patent are intended to have their broadest meaning consistent with the requirements of law. Where alternative meanings are possible, the broadest meaning is intended. All words used in the claims are intended to be used in the normal, customary usage of grammar and the English language.

BRIEF DESCRIPTION OF THE DRAWINGS

The stated and unstated features and advantages of the present inventions will become apparent from the following descriptions and drawings wherein like reference numerals represent like elements in the various views, and in which.

DETAILED DESCRIPTION OF PREFERRED EMBODIMENTS

Set forth below is a description of what is currently believed to be the preferred embodiments or best representative examples of the inventions claimed. Future and present alternatives and modifications to the embodiments and preferred embodiments are contemplated. Any alternatives or modifications which make insubstantial changes in function, purpose, structure or result are intended to be covered by the claims of this patent.

Figure 1:
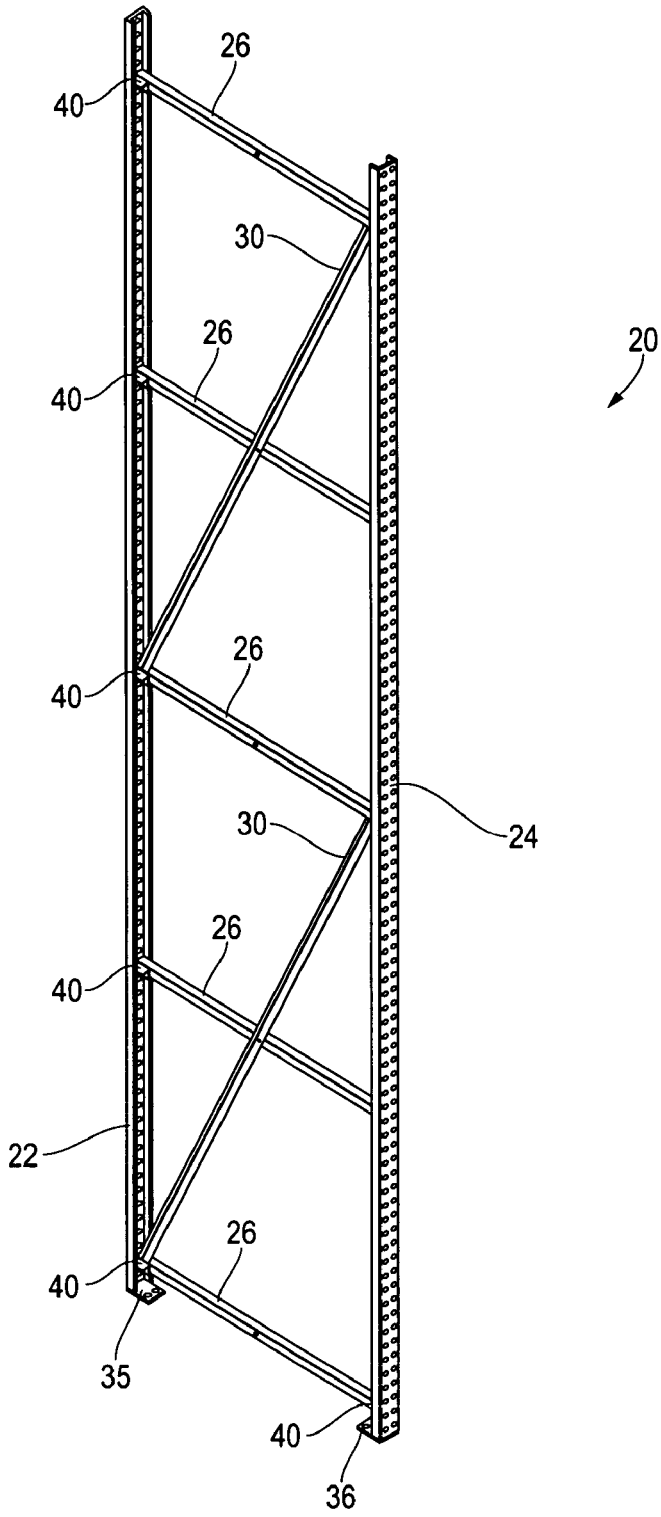
FIG. 1 is a rear perspective view of a preferred embodiment of a bolted rack truss of the present invention.

A preferred embodiment of the bolted truss of the present inventions is shown generally as 20 in FIG. 1. The preferred components of preferred truss 20 are shown in FIGS. 1-6 and 11. A preferred embodiment of the lower truss reinforcement of a bolted truss 20 is shown generally as 50 in FIG. 7. Preferred components of preferred lower reinforcement 50 are shown in FIGS. 7-10. It will be understood by those of skill in the art that bolted truss 20 inventions may be used alone or in combination with truss reinforcement inventions 50. Similarly, truss reinforcement inventions 50 may be used alone or in combination with the bolted truss 20 inventions.

By reference to FIGS. 1-6, bolted truss 20 includes a front column 22 and a rear column 24. A plurality of transverse beams 26 and diagonal braces 30 are also provided between front column 22 and rear column 24. In the preferred embodiment, columns 22 and 24 are made from structural channels having a web 21 and flanges 23 and 25. The bottom of front column 22 may be provided with a foot 35 and the bottom of rear column 24 may also be provided with a foot 36. Feet 35 and 26 may be used to secure truss 20 to the floor and may also be incorporated into the truss reinforcement 50 invention, as hereinafter described. It will be understood by those of skill in the art that a wide variety of structural members may be used to practice the present inventions. The above described components are bolted together as hereinafter described to form bolted truss 20.

Figure 2:
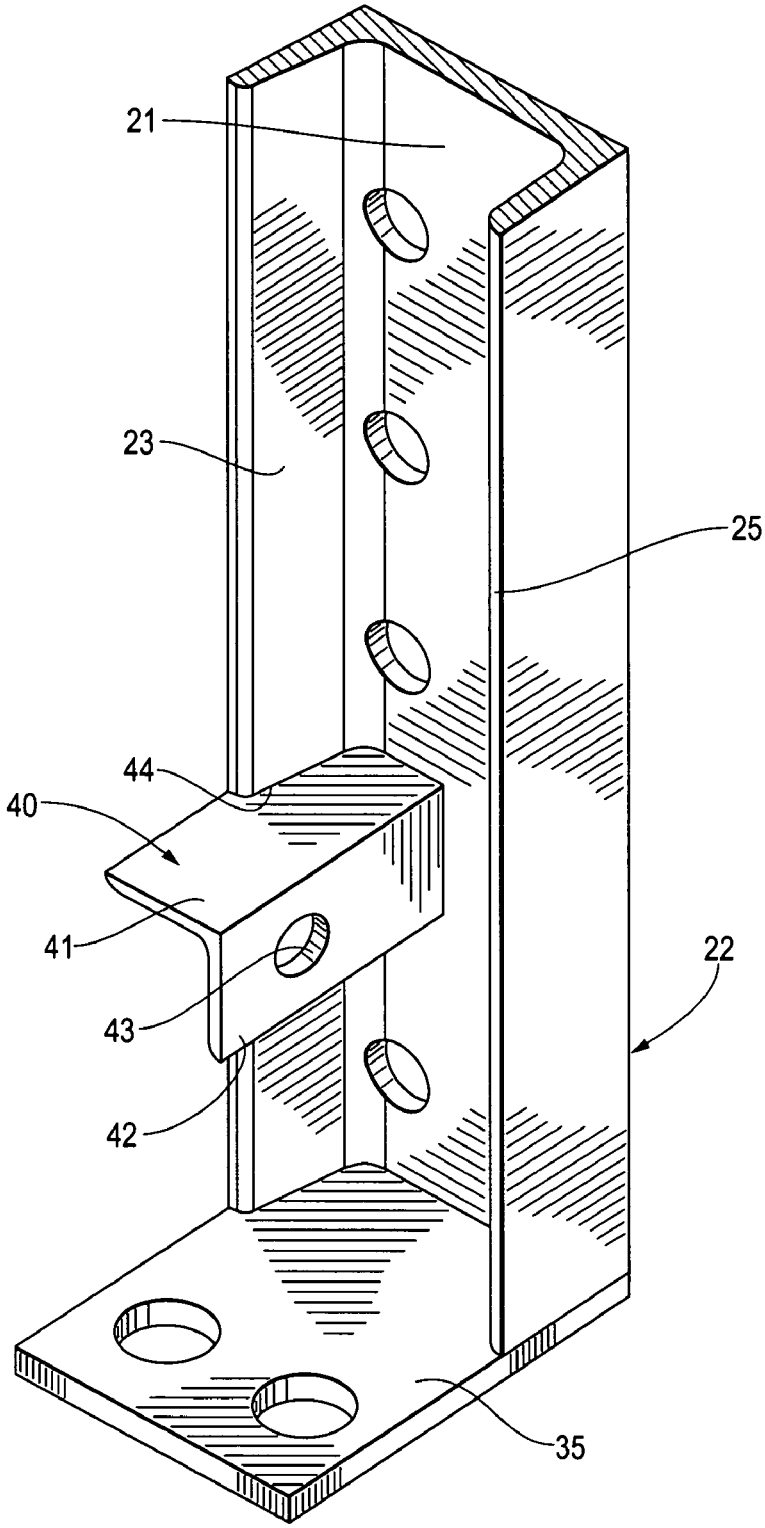
FIG. 2 is a rear perspective view of a preferred stub of a preferred embodiment of the present invention shown on the bottom portion of the front column of the truss.
Figure 3:
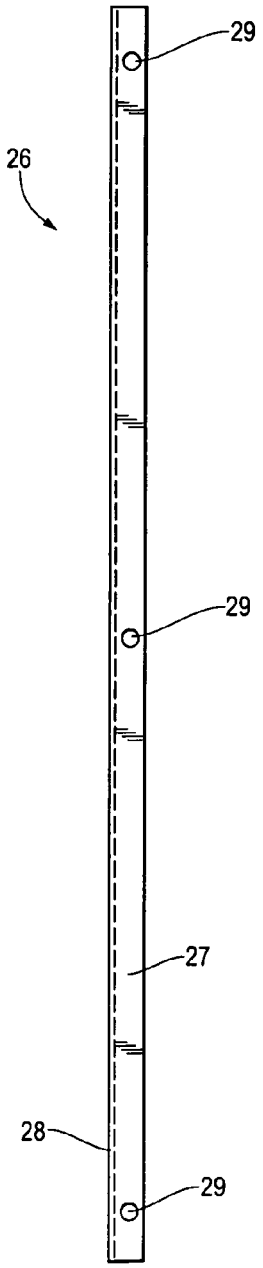
FIG. 3 is a side view of a preferred transverse beam of the present invention.
Figure 4:
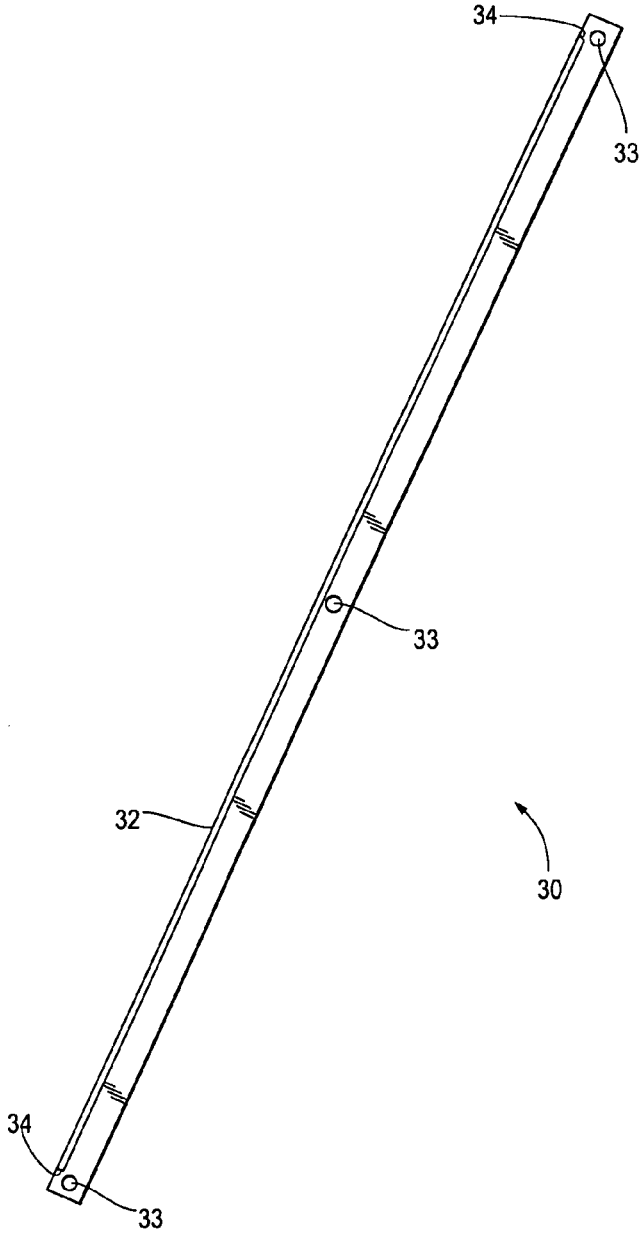
FIG. 4 is a side view of a preferred embodiment of a diagonal brace of the present invention.
Figure 5:
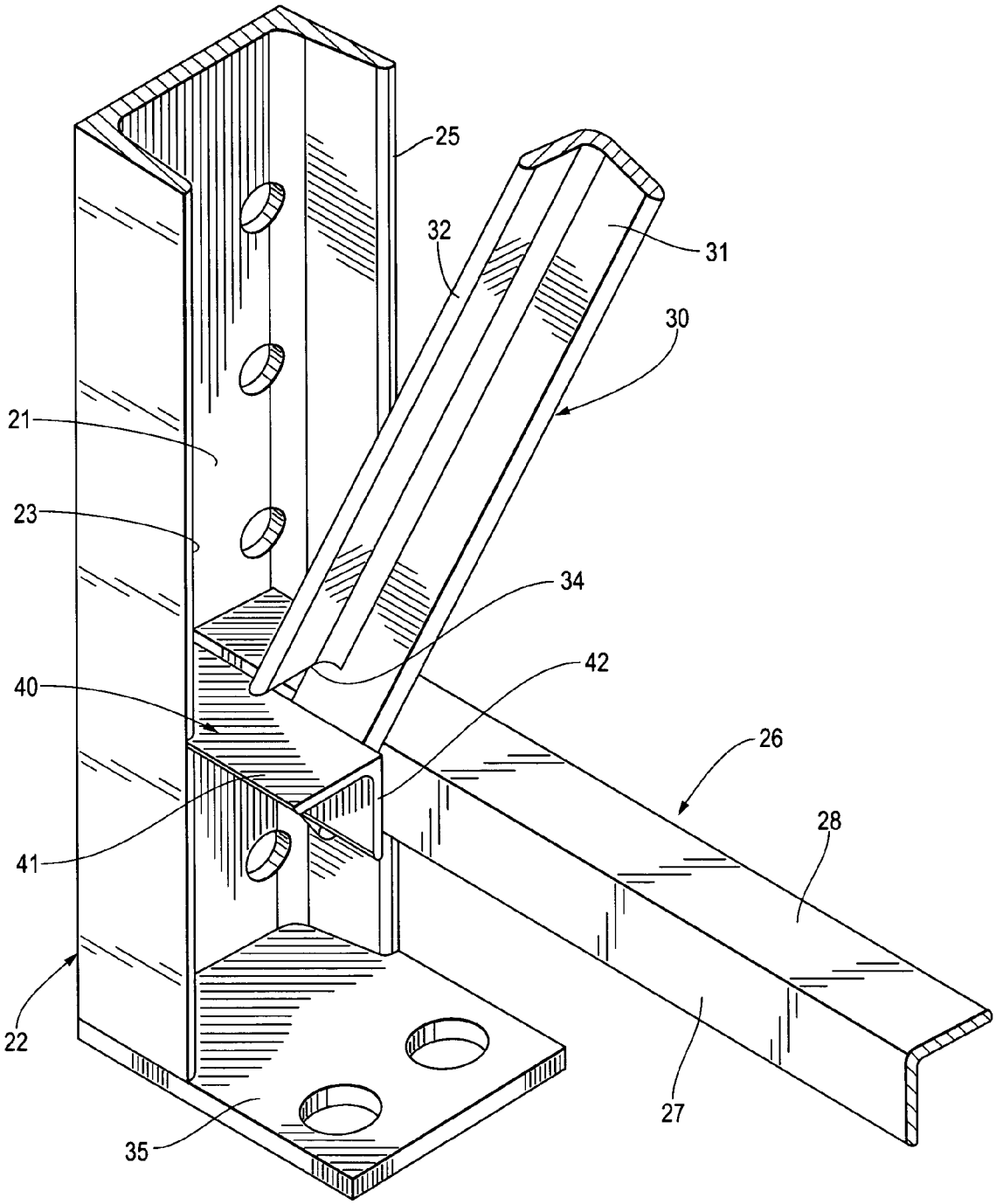
FIG. 5 is a rear perspective view of a preferred stub of a preferred embodiment of the present invention shown on the base portion of the front column of the truss with the preferred transverse beam and diagonal brace shown in the installed position.
Figure 6:
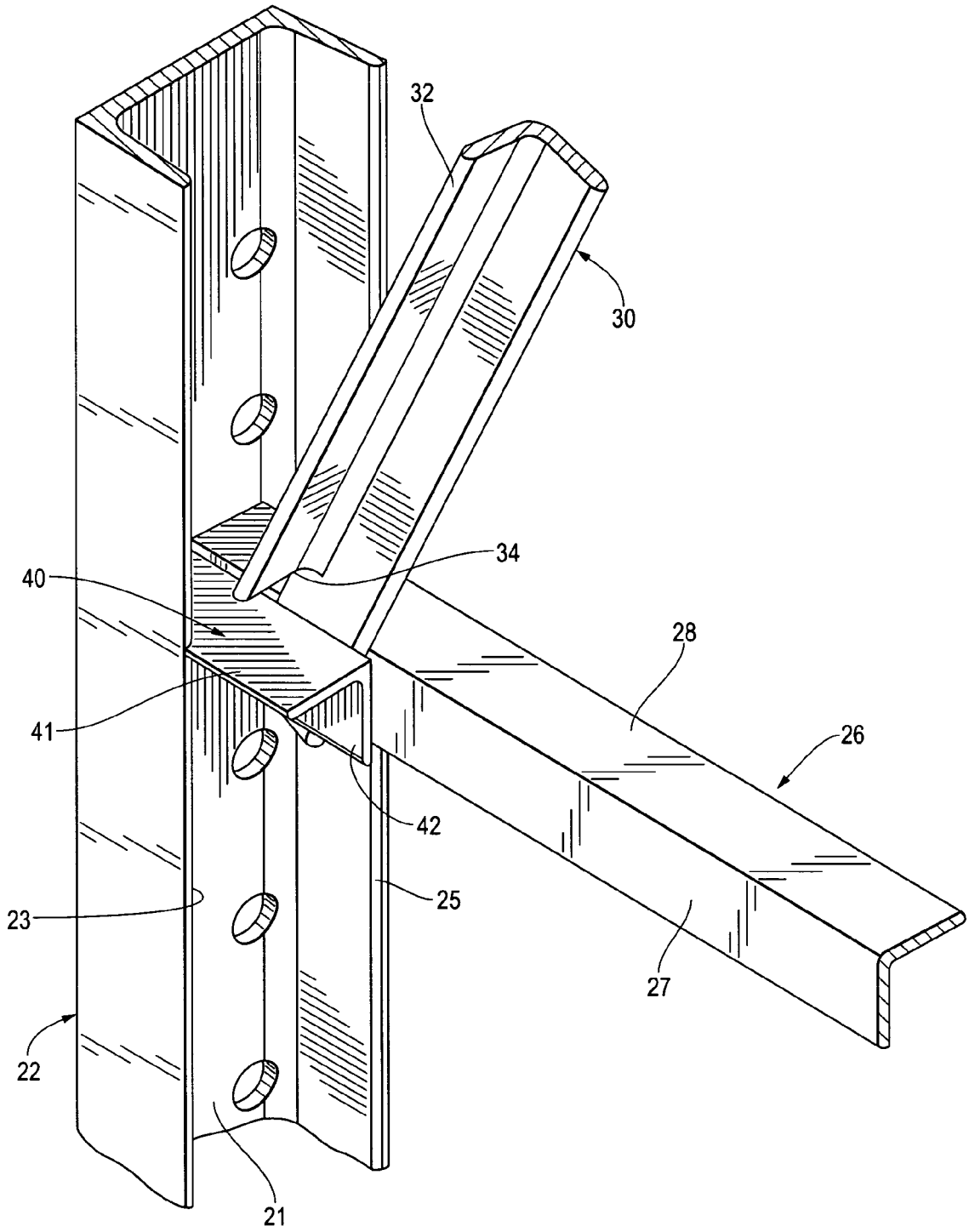
FIG. 6 is a rear perspective view of a preferred stub of a preferred embodiment of the present invention shown on an intermediate portion of the front column with the preferred transverse beam and diagonal brace shown in an installed position.
Figure 7:
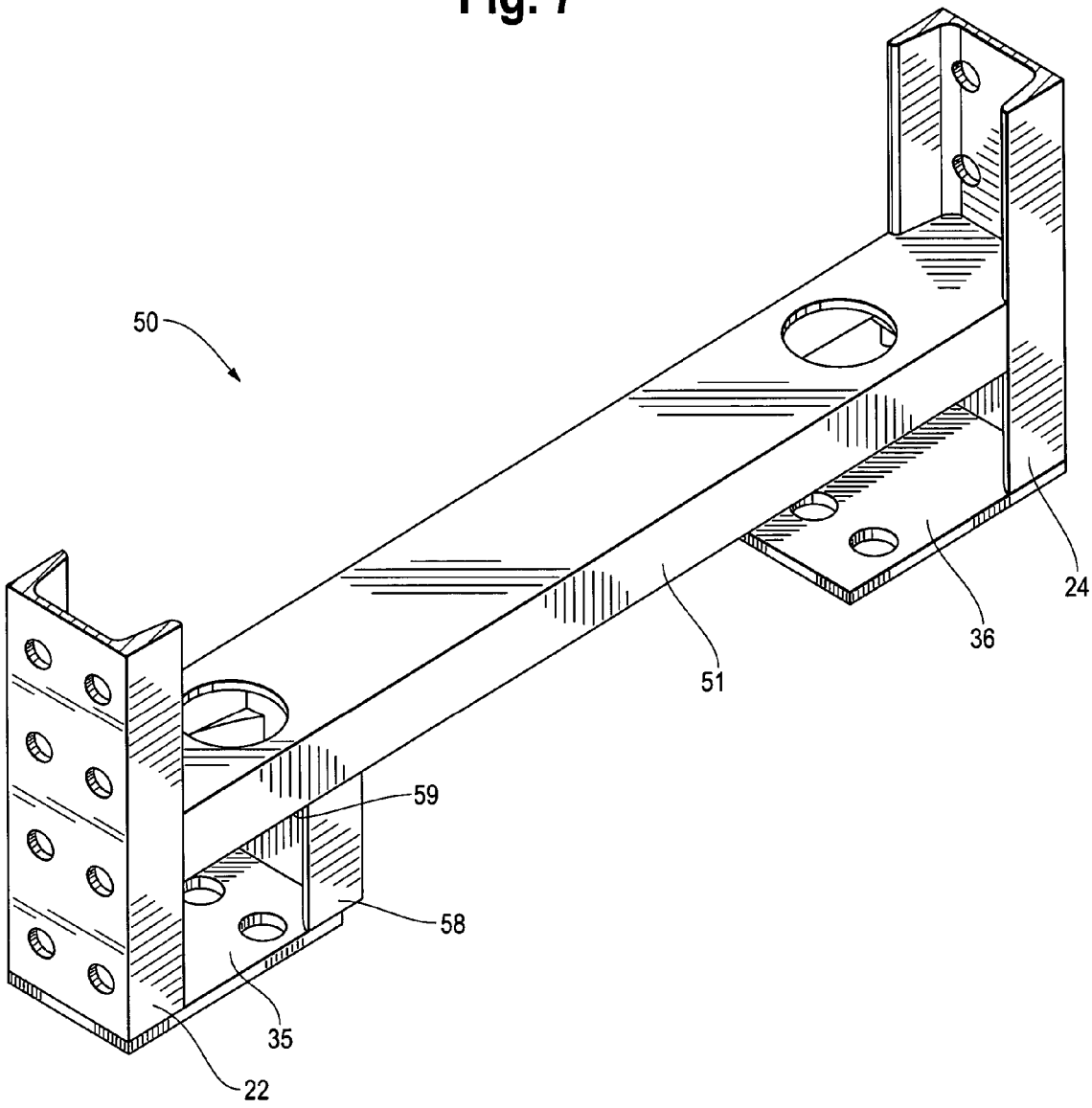
FIG. 7 is a side perspective view of a preferred embodiment of the truss reinforcement of the present invention shown installed at the bottom of the truss.

A series of stubs 40 are provided on the inside face of front column 22. Rear column 24 is also provided with a series of stubs 40 which are mounted on the opposing inside face of rear column 24. As shown in FIGS. 2, 5 and 6, stub 40 is welded or otherwise secured to the interior of front column 22 along flange 23 and web 21. Stubs 40 on rear columns 24 are similarly mounted. In a preferred embodiment, stubs 40 are formed from structural angles having a horizontal leg 41 and a vertical leg 42, which is provided with a hole 43. The horizontal leg 41 of stub 40 is notched 44 so that it can be securely attached to the inside surface of flange 23 of column 22 by welding or other well known means.

Similarly, the interior of rear column 24 is provided with a series of stubs 40 that oppose stubs 40 on front column 22. Stubs 40 on front column 22 and rear column 24 are used to secure transverse beams 26 as well as diagonal braces 30, as hereinafter described. Again, it will be understood by those of skill in the art that stubs 40 may be formed from a wide variety of structural components consistent with the inventions.

Preferred transverse beam 26 is formed from a structural angle having a vertical leg 27 and a horizontal leg 28. A series of holes 29 are provided, one in the center and one at each end (see FIG. 3). Diagonal brace 30 is also preferably formed from a structural angle. It includes a vertical flange 31, a horizontal flange 32 and three holes 33, one at each end and one in the center. The horizontal flange 32 of each end of brace 30 has a notch 34 in the horizontal flange 32 so that it may be secured to stub 40.

As a result of the unique aspects of the present invention, the truss components, such as columns 22 and 24 and their associated stubs 40, transverse beams 26 and diagonal brace 30 may be fabricated and shipped to the site prior to assembly. Once at the site, transverse beams 26 are installed between front and back columns 22 and 24 by bolting one end of transverse beam 26 to stub 40 on the front column 22 through holes 43 on stub 40 and holes 29 at one end of transverse beams 26. The other end of transverse beams 26 is attached to stub 40 of rear column 24 in the same way. Preferably, vertical leg 42 of stub 40 is parallel to and faces vertical leg 27 of transverse beams 26 (see FIGS. 5 and 6).

Diagonal brace 30 may be installed on a stub 40 of front column 22 and a stub 40 that is two stubs 40 higher in on back column 24 as shown in FIG. 1. One end of diagonal brace 30 is secured between vertical leg 42 of stub 40 and vertical leg 27 of transverse beam 26 using a bolt through holes 43, 33 and 29 of the respective members. Notch 34 on horizontal flange 32 of diagonal brace 30 enables the horizontal flange 32 to clear the horizontal leg 41 of stub 40. The other end of diagonal brace 30 is attached to stub 40 of rear column 24 in the same manner. The center of diagonal brace 30 is then attached to the center of the next higher transverse beam 26 using a bolt through center holes 33 of diagonal brace 30 and center holes 29 of transverse beam 26 (see FIG. 1).

In this preferred form of installation and structural components (horizontal flange 41 of stub 40, one end of vertical flange 31 of diagonal brace 30 and horizontal flange 28 of transverse beam 26), the entire interior face between flanges 23 of front and rear columns 22 and 24 is filled (see e.g., FIG. 6). This configuration provides increased strength. It also reduces the potential for twisting of the components.

Figure 11:
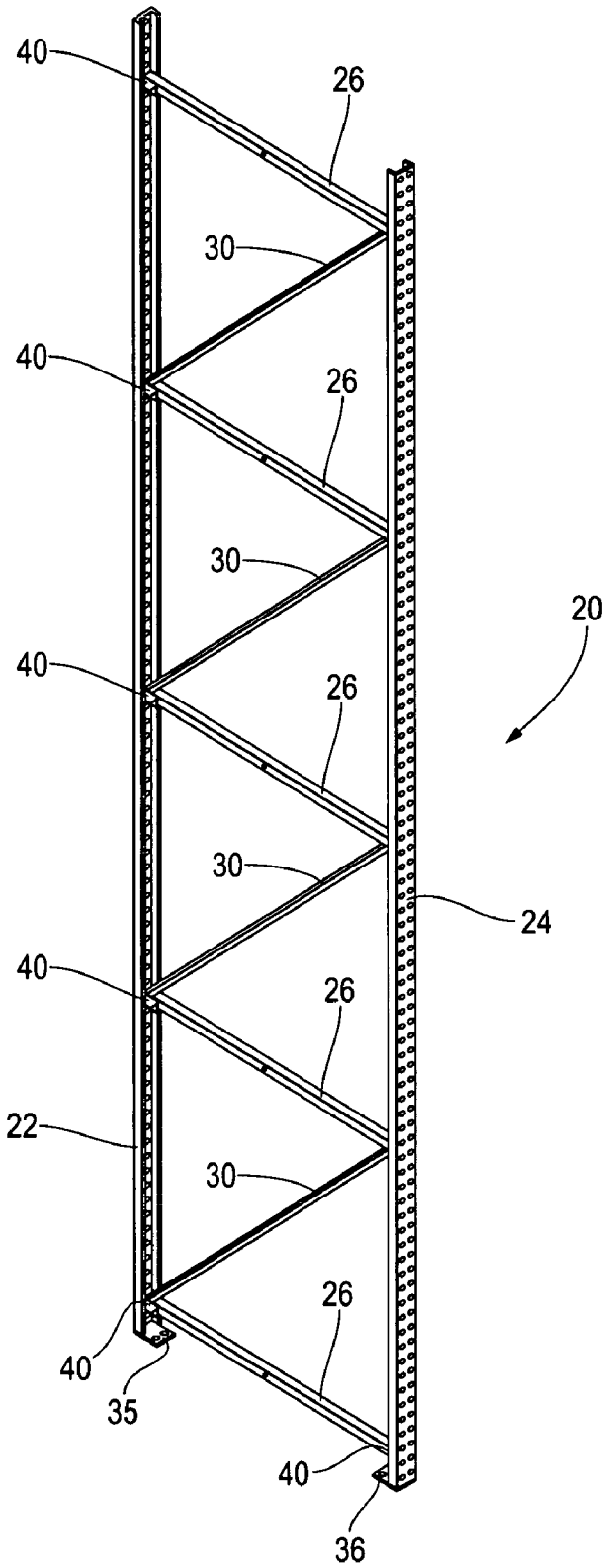
FIG. 11 is a rear perspective view of a preferred embodiment of the present invention showing an alternative embodiment of a diagonal brace of the present invention.

A preferred alternative to the above arrangement of diagonal brace 30 is also appropriate and is shown in FIG. 11. In this embodiment, a diagonal brace 30 is provided diagonally between each pair of transverse beams. For example, one end of diagonal brace 30 is secured on a stub 40 of front column 22 as described above. The other end of diagonal brace 30 is attached to the next higher stub 40 of rear column 24, also in the same manner as described above. Of course, in this embodiment, there is no need for center holes 33 of diagonal brace 30 or center holes 29 of transverse beam 26.

A preferred embodiment of the truss reinforcement 50 inventions may generally be seen by reference to FIGS. 7-10. Truss reinforcement 50 includes a stiffening beam 51 formed from a structural channel having a horizontal web 52 and two vertical flanges 53. A hole 54 is provided on the front end of stiffening beam 51 and a hole 55 is provided on the back end of stiffening beam 51 to function as hereinafter described. A vertical support leg 56 is attached to the underside of stiffening beam 51 generally toward the front of member 51. Vertical support leg 56 is formed from a structural channel member having a web 57 and two flanges 58. A hole 59 is provided on web 57 to function as hereinafter described.

Figure 8:
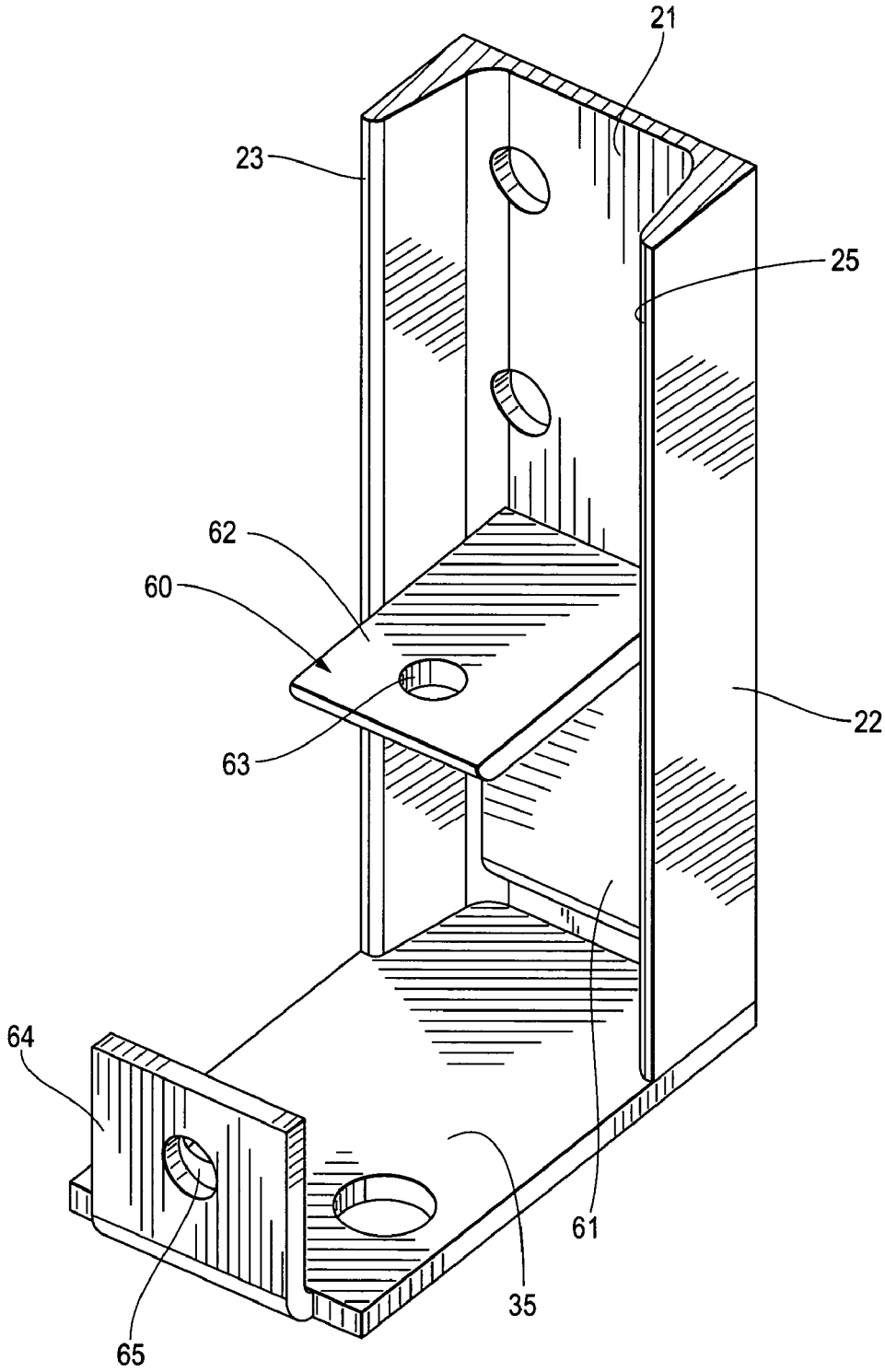
FIG. 8 is a rear perspective view of the front portion of a preferred embodiment of the truss reinforcement of the present invention.

The bottom of front column 22 is provided with a horizontal locking tab 60 (see FIG. 8). In a preferred embodiment, horizontal locking tab 60 is made from a piece of a structural angle having a vertical flange 61 and a horizontal flange 62. Vertical flange 61 is welded to the inside of web 21 of front column 22 between flanges 23 and 25. Horizontal flange 62 is provided with a hole 63 that is designed to mate with hole 54 on the front stiffening member 51.

A vertical locking tab 64 is also provided in association with front column 22. Vertical locking tab 64 may be formed from or attached to front foot 35 of front column 22. Vertical locking tab 64 includes a hole 65 that is designed to mate with hole 59 on web 57 of vertical support leg 56. It will be understood by those of skill in the art that vertical locking tab 64 is spaced from front column 22 the same distance as vertical support leg 56 such that the web 57 of support leg 56 mates with vertical locking tab 64.

Rear column 24 is provided with a horizontal locking tab 60 (see FIG. 9) that opposes horizontal locking tab 60 on front column 22. The horizontal locking tab 60 on rear column 24 also includes a vertical flange 61 attached to inside web 21 of front column 24 and a horizontal flange 62. A hole 66 is provided on horizontal flange 62 that is designed to align with hole 55 on the rear end of stiffening beam 51.

Horizontal stiffening member 51 is installed by placing the front end on horizontal locking tab 60 and bolting them together through holes 54 of stiffening member 51 and holes 63 of horizontal locking tab 60. Similarly, the rear end of horizontal stiffening member 51 is placed on horizontal locking tab 60 which is then bolted through holes 55 and 66. Vertical support leg 56 is bolted to vertical locking tab 64 through its holes 65 and hole 59 on the web 57 of vertical support leg 56. In addition to providing extra strength to prevent abuse to the lower front column 22, when vertical support leg 56 is attached to vertical locking tab 64, the front 22 and rear 24 columns are brought into proper vertical alignment. Thus, the present inventions also provide a means for self-alignment of the truss columns 22 and 24 during assembly.

Figure 9:
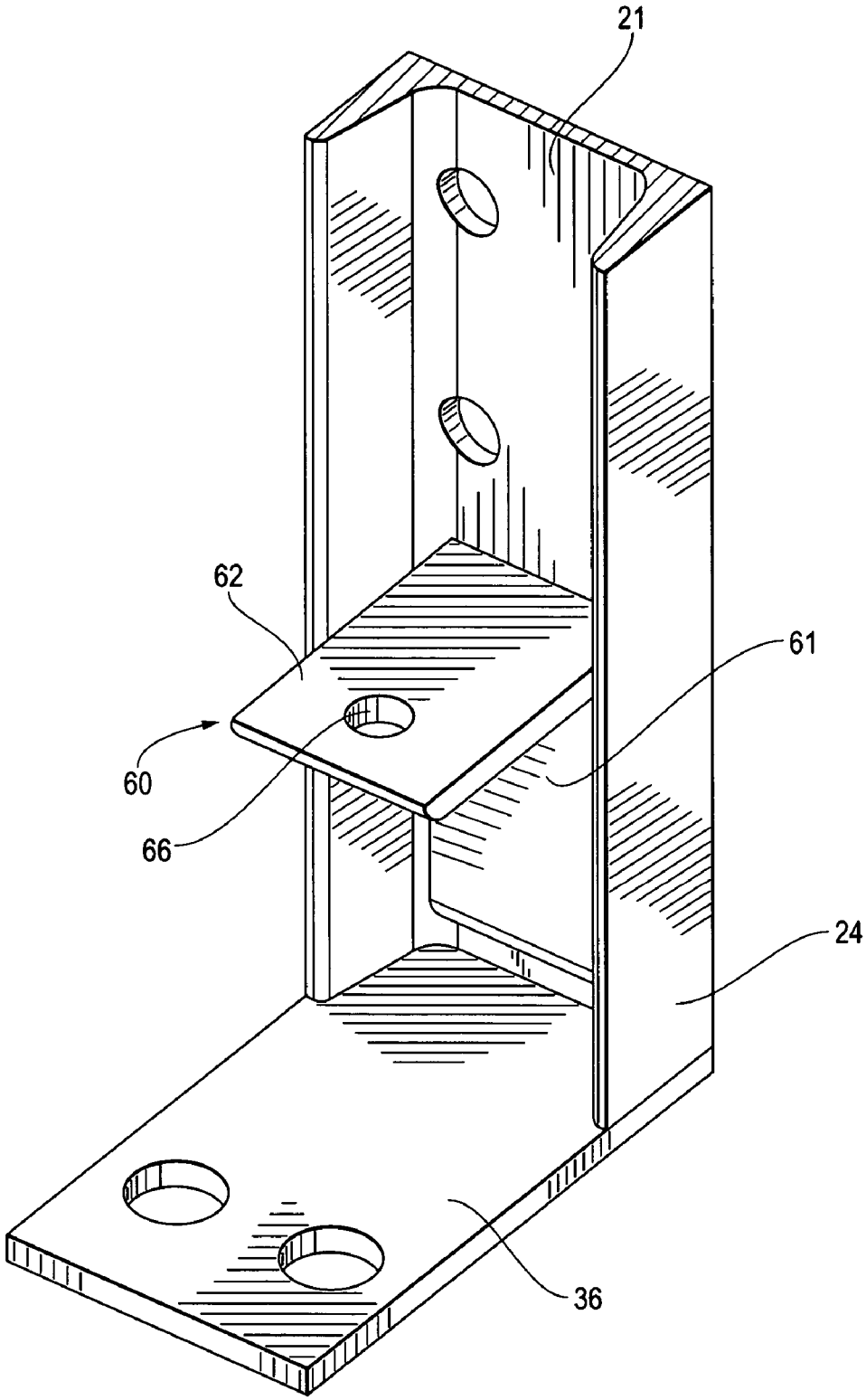
FIG. 9 is a rear perspective view of the rear portion of a preferred embodiment of the truss reinforcement of the present invention.
Figure 10:
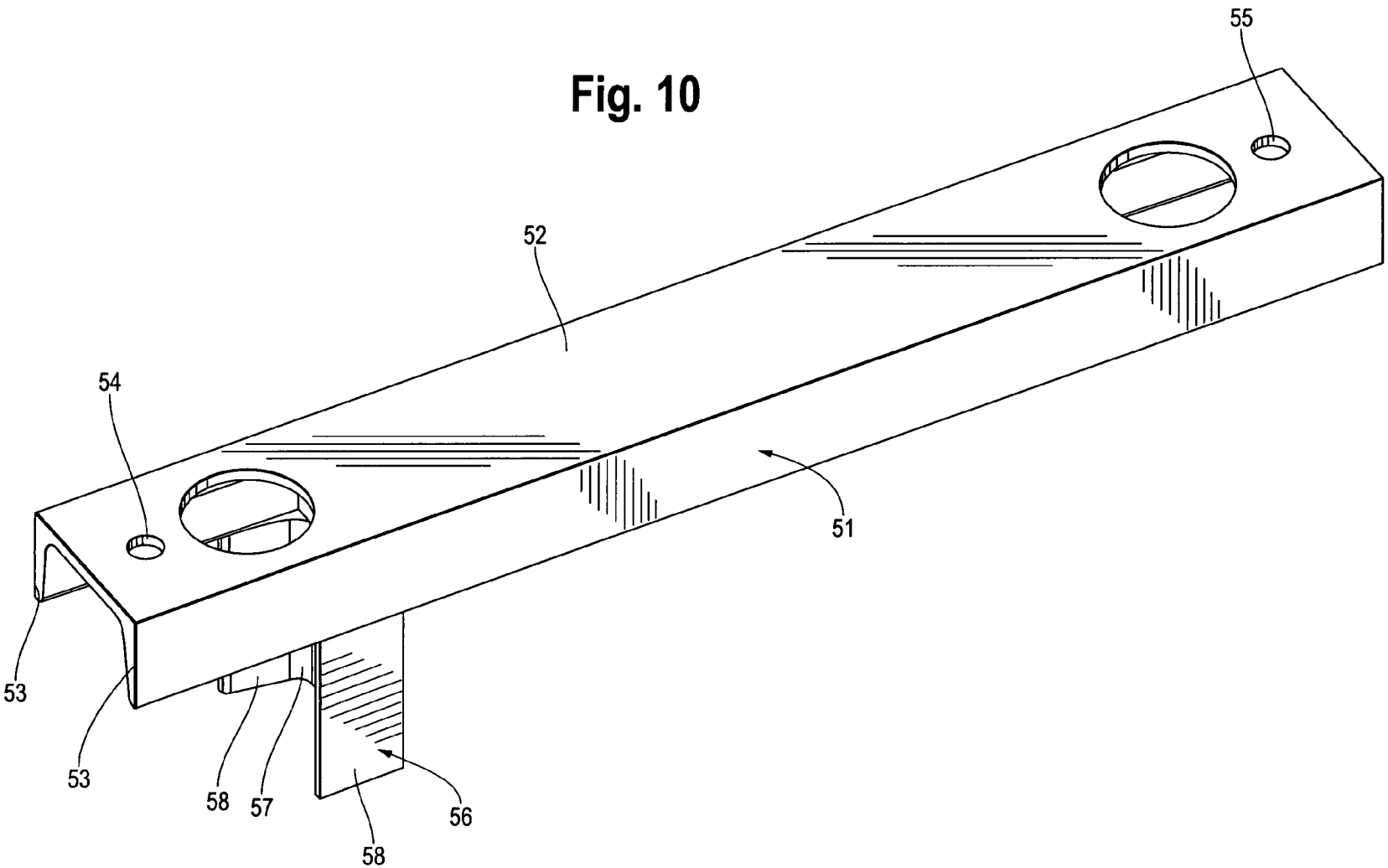
FIG. 10 is a side perspective view of a preferred transverse reinforcement beam of a preferred embodiment of the truss reinforcement of the present invention.

In an alternative embodiment of truss reinforcement 50, the lower portion of front column 22 is provided with the same components as rear column 24, as shown in FIG. 9. Specifically, like rear column 24, front column 22 is provided with a horizontal locking tab 60 having a bolt hole 66. In this embodiment, horizontal stiffening member 50 does not require a vertical support leg 58 or a vertical locking tab 64. Thus, horizontal stiffening member 51 is installed between the columns 22 and 24 and bolted at each end to horizontal locking tab 60. This embodiment is particularly useful in, but not limited to, drive-in rack systems.

It will be understood by those of skill in the art that the truss reinforcement inventions 50 may be practiced using a wide variety of structural members other than the types of members shown in the preferred embodiment. In addition, a vertical support leg 56 and a vertical locking tab 64 may be provided on the rear end of stiffening beam 51 and rear column 24. Such an arrangement, while acceptable, is not generally preferred because most of the abuse during loading and unloading occurs to the lower portion of front column 22.

The above description is not intended to limit the meaning of the words used in or the scope of the following claims that define the invention. Rather, it is contemplated that future modifications in structure, function or result will exist that are not substantial changes and that all such insubstantial changes in what is claimed are intended to be covered by the claims. Thus, while preferred embodiments of the present inventions have been illustrated and described, it will be understood that changes and modifications can be made without departing from the claimed invention.

Various features of the present inventions are set forth in the following claims.

What is claimed is:

1. A reinforced truss for use in storage racks including at least one front column having a generally u-shaped interior face and a foot on a lower end, and at least one rear column having a generally u-shaped opposing interior face, comprising:

a horizontal locking tab secured to the inside face of the front column;

a vertical locking tab spaced rearwardly from said front column, said vertical locking tab attached to and vertically upstanding from said foot;

a horizontal locking tab secured to the inside face of the rear column;

a horizontal stiffening member including a front end and a rear end, the front end of said stiffening member having a downwardly projecting vertical support leg spaced rearwardly from the front end;

and wherein the front end of the horizontal stiffening member is capable of being bolted to the horizontal locking tab of the front column, the rear end of said stiffening member is capable of being bolted to the horizontal locking tab on the rear column, and the downwardly projecting vertical support leg is capable of being bolted to the vertically upstanding locking tab on said foot.

2. The invention of claim 1 wherein the horizontal stiffening member is formed from structural channels.

3. The invention of claim 1 wherein the horizontal locking tabs are formed from structural channels.

4. A bolted truss for use in forming storage racks comprising:

at least one front column having a substantially open interior face and a foot for placement on a warehouse floor, and at least one rear column having an opposing substantially open interior face and a foot for placement on a warehouse floor;

a plurality of stubs secured to the interior face of the front column and a plurality of stubs secured to the interior of the rear column, the stubs on the front and rear columns opposing each other, and wherein each of said stubs includes a horizontal leg, at least a portion of which is secured to the interior face of said columns;

a plurality of transverse beams having a front and back end which are placed between the front and rear columns, the front end of which is bolted to the stub on the front column and the rear end of which is bolted to the opposing stub on the rear column;

a horizontal locking tab secured to the inside face of a lower portion of the front column;

a vertical locking tab spaced rearwardly from said front column, said vertical locking tab attached to and vertically upstanding from said front foot or said warehouse floor;

a horizontal locking tab secured to the inside face of a lower portion of the rear column;

a horizontal stiffening member including a front end and a rear end, having a downwardly projecting vertical support leg spaced rearwardly from the front end, wherein the front end of the horizontal stiffening member is capable of being bolted to the horizontal locking tab of the front column, the rear end is capable of being bolted to the horizontal locking tab on the rear column, and the vertical support leg is capable of being bolted to the vertical locking tab.

* * * * *